US005455548A

United States Patent [19]

Grandchamp et al.

[11] Patent Number: 5,455,548

[45] Date of Patent: Oct. 3, 1995

[54] BROADBAND RIGID COAXIAL TRANSMISSION LINE

[75] Inventors: Brett J. Grandchamp, South Portland; Cole N. Plummer, South Casco; Richard I. Bibber, Gray; Charles D. Brown, Raymond, all of Me.

[73] Assignee: General Signal Corporation, Stamford, Conn.

[21] Appl. No.: 202,997

[22] Filed: Feb. 28, 1994

[51] Int. Cl.[6] ..... H01P 1/04; H01P 3/06

[52] U.S. Cl. ..... 333/260; 439/578; 174/28; 174/88 C

[58] Field of Search ..... 333/243–245, 333/260; 174/28, 88 C, 91; 439/578

[56] References Cited

U.S. PATENT DOCUMENTS

| | | | |
|---|---|---|---|
| 2,955,148 | 10/1960 | Graham et al. | 174/88 C |
| 3,373,242 | 3/1968 | Sewell | 333/244 X |
| 3,955,871 | 5/1976 | Kruger | 333/260 X |
| 4,019,162 | 4/1977 | Banning | 323/244 |

OTHER PUBLICATIONS

David Dettinger "The Optimum Spacing Of Bead Supports In Coaxial Line At Microwave Frequencies"—Wheeler Laboratories, Inc., Great Neck, N.Y., 1967 IRE Convention Record; vol. 5, Part I, pp. 250–253.

*Primary Examiner*—Benny Lee
*Attorney, Agent, or Firm*—Henry D. Pahl, Jr.

[57] ABSTRACT

The rigid coaxial transmission line disclosed herein is made up of multiple sections having outer conductors which are joined together at flanges and make up a desired length. Rather than being of equal length, the sections vary in length progressively to prevent the reflections caused by the flanges from accumulating at any frequency within the band at which the transmission line is to operate.

10 Claims, 1 Drawing Sheet

BROADBAND RIGID COAXIAL TRANSMISSION LINE

BACKGROUND OF THE INVENTION

The present invention relates to rigid coaxial transmission lines and more particularly to such a line having low VSWR characteristics over a substantial band of frequencies.

For various high power applications, e.g., UHF television transmission, it is conventional to couple RF power between the transmitter and the antenna through a rigid coaxial transmission line. Further, in some applications, the transmitter may be located a substantial distance from the antenna so that the transmission line is necessarily made up of multiple sections. Conventionally, such multi-section runs are made up of sections which are essentially all of the same length since this simplifies design and manufacturing. To prevent accumulating interference effects, the length of each section is normally selected so as to not be a multiple of a half wavelength of the frequency corresponding to the channel allocation for the particular T.V. station. In some instances however, an antenna may be operated at a variety of frequencies within a substantial band and this prior art technique may be ineffective in preventing reflections accumulating to an unacceptable voltage standing wave ratio (VSWR).

Among the several objects of the present invention may be noted the provision of a multi-section run of RF transmission line having low VSWR characteristics over a substantial band of frequencies; the provision of such a transmission line which can be constructed in the form of a rigid coaxial transmission line; the provision of such a transmission line which can be constructed in coaxial sections having outer conductors which are connected together at flange joints; the provision of such a transmission line which is highly reliable and which is of relatively simple and inexpensive constructions. Other objects and features will be in part apparent and in part pointed out hereinafter.

SUMMARY OF THE INVENTION

Briefly, the present invention involves a multi-section run of RF transmission line having low VSWR characteristics over a band of frequencies F1 to F2 where F3 is a selected frequency within that band. The transmission line comprises a series of N sections connected by joints which cause small impedance discontinuities. In accordance with the invention, the lengths l of the N sections are distributed essentially according to the relationship $$l = L + \frac{\lambda(n-1)}{2N} \text{ for } n = 1 \text{ to } N$$

where L is a nominal section length, λ is the wavelength corresponding to F3 and n is a designator for the respective section.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
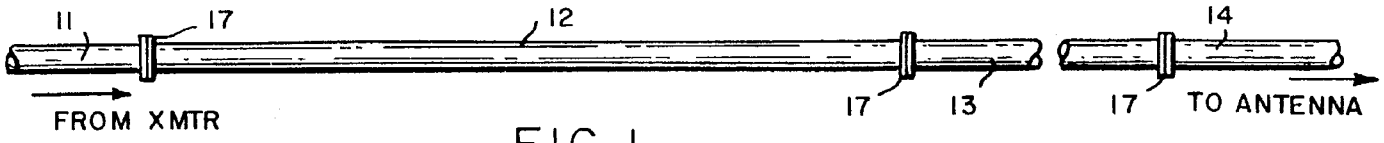
FIG. 1 is a side view of a multi-section run of rigid coaxial transmission line constructed in accordance with the present invention.

Referring now to FIG. 1, the run of coaxial transmission line illustrated there comprises a plurality of sections 11, 12, 13 and 14 joined by flanged connections 17. As is understood, such a multi-section run of coaxial transmission line may be used to connect a television transmitter to an antenna located an appreciable distance away. Such lengthy runs are necessarily made up of sections since the length of a coaxial transmission line segment which can be shipped is limited, as are the lengths of appropriate tubing available commercially. In the particular embodiment being described by way of example, the outer conductors of the coaxial transmission line are six and one eighth inch in diameter and the individual sections are nominally twenty feet long.

Figure 2:
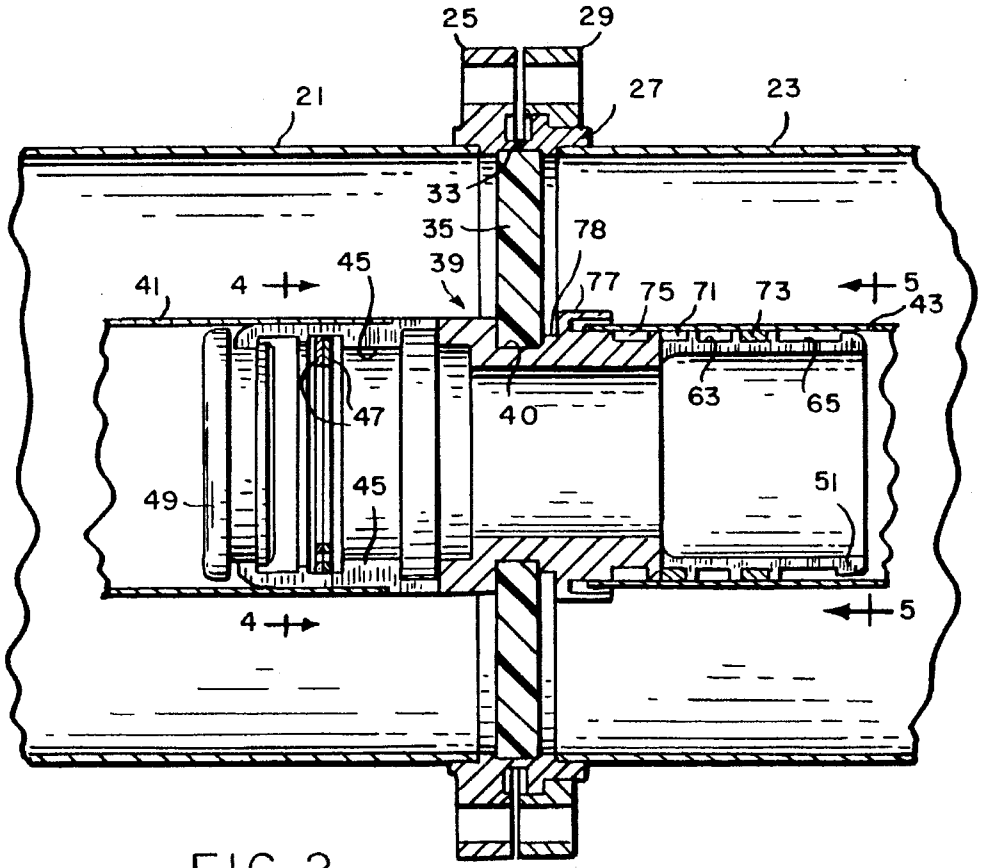
FIG. 2 is a side view, in section, of a joint between two sections of the line of FIG. 1 showing the flange joint which connects outer conductors and a connector which joins the inner conductors of each coaxial section.

Referring now to FIG. 2, the outer conductors of adjacent coaxial line sections are designated by reference characters 21 and 23. A one piece coupling flange 25 is welded to the right hand end of the outer connector 21 while the conductor 23 is provided with a two part assembly having an inner ring 27 which is welded to the conductor 23 and an outer, rotatable clamping ring 29 which can be bolted to the flange 25 to draw the two sections together into solid electrical contact.

The flange 25 and ring 27 are cut away as illustrated, to provide a recess, as designated by reference character 33, which can capture and retain an annular anchor insulator 35 when the outer sections are bolted together. The anchor insulator 35 serves to locate a coupler assembly, designated generally by reference character 39, which joins adjacent inner conductor sections 41 and 43. The anchor insulator is received with in a groove 40 in the coupler assembly. Anchor insulator 35 may, for example, be constructed of polytetrafluoroethylene (PTFE) and is preferably split so as to allow it to be assembled over the coupler assembly 39.

The left-hand side of the coupler assembly 39 is essentially conventional and is adapted to fixedly attach to the adjacent end of the respective inner conductor 41. The end of the left hand portion of the coupler assembly is axially cut at several circumferential positions so as to form radially compliant fingers 45. These fingers are then resiliently forced outwardly into firm contact with the conductor 41 by snap ring springs 47. An annular plug 49 prevents splitting the finger apart if there is an initial misalignment during assembly.

The right-hand side of the coupler assembly 39 also includes a portion, designated generally by reference character 51, which is adapted to fit within the respective inner conductor section 43. This right-hand portion also provides a series of five annular grooves which function as explained hereinafter. Portion 51 however has an outer diameter slightly smaller than the inner diameter of the conductor 43 so that clearance is provided between these parts.

An annular separation is maintained between the coupler portion 51 and the inner coaxial conductor 43 by rings 71 and 73 polytetrafluoroethylene (PTFE) located in the second and fourth of the grooves, counting from the left. The third and fifth grooves, designated by reference characters 63 and 65, are left empty. This arrangement thus establishes and maintains alignment of the inner conductor 43 relative to the portion 51 without electrical contact. Electrical contact between the coupler assembly 39 and the inner connector 43 is established at a single, well defined, axial position by means of a coiled wire spring 75 located in the first groove. The wire forming spring 75 is coiled with an elliptical cross-section and is preferably silver plated to provide good electrical contact with both the coupler assembly 39 and the inner conductor 43. Such springs have been used heretofore in various connector environments and are conventionally referred to as watch band spring contacts.

As will be understood, the right-hand end of the inner conductor section 43 will be fixedly attached with respect to its corresponding outer conductor section by the next connector 17 in the series of coaxial sections in the same manner as the right-hand end of the inner conductor section 41. Thus, as differential expansion occurs between the inner and outer conductors, the left-hand end of the inner conductor 43 will move axially with respect to the coupler member 39. The PTFE rings 71 and 73 freely permit this axial movement while maintaining radial alignment and preventing electrical contact between the inner conductor 43 and the coupler assembly except as provided by the watch band spring contact 75.

A tubular shield 77 formed integrally with the coupler assembly 39 extends from an axial position adjacent the anchor insulator over the adjacent end of the inner conductor 43, to a point adjacent the groove 61 which holds the watch spring contact 75. The axial length of this shield 77 is greater than the amount of differential axial expansion expected between each inner conductor section 43 and the corresponding outer conductor section 23.

In other words, when the inner conductor 43 is least expanded with respect to the outer conductor 23, the left-hand end of the conductor will still be within the annular space defined by the shield 77. Further, when the inner conductor 43 is maximally expanded with respect to the outer conductor 23, the end of the inner conductor will not reach the end or bottom of the space enclosed by the shield 77.

An intermediate step 78 is provided between the shield 77 and the groove 40 which receives the anchor insulator 39. The diameter of the groove 40, the step 78 and the shield 77 are selected in relation to each other to provide axial sections with offsetting impedance characteristics as is well understood in the connector art.

From the foregoing, it will be understood by those skilled in the art that the shield 77 effectively masks or hides, from the r.f. electromagnetic field which exists between the inner and outer conductor, the variable gap which would otherwise be present between the movable end of the inner conductor 43 and the adjacent portion of the coupler assembly 39. Thus, differential expansion does not change any of the impedance discontinuities which exist at the connector.

While the flanged connectors 17 are preferably designed so as to introduce a minimal impedance discontinuity, such flanged joints necessarily do introduce some reflection of RF energy. In accordance with the present invention, the actual lengths of the individual sections 11–14 are varied progressively around a nominal length so as to minimize the accumulation of reflections from the flanged connector impedance discontinuities. In particular, it has been found that a particular regular progression of section lengths provides a highly advantageous low VSWR characteristic over a substantial band of frequencies.

In the preferred embodiment illustrated, this progression of length is implemented as follows. The individual section lengths are assumed to be in the order of twenty feet and this nominal length is designated as L in the formula described hereinafter. Likewise, the transmission line is intended to operate over a band between two frequencies F1 and F2. In this example these two frequencies may be the ends of the UHF T.V. band 470 MHz to 806 MHz.

It is known that, in rigid coaxial transmission lines, the problems caused by manufacturing tolerances and random discontinuities are worse at higher frequencies. Accordingly, a nominal design frequency F3 is chosen near the higher end of the band, i.e, a frequency of 775 MHz. The wavelength corresponding to frequency F3 is designated as λ which, in this particular example, is 15.23 inches. In accordance with the invention, the length l of the N sections are distributed essentially according to the relationship $$l = L + \frac{\lambda(n-1)}{2N} \quad \text{for } n = 1 \text{ to } N$$

where L is the nominal section length, λ is the section length corresponding to the nominal design frequency F3, and n is a designator for the respective section. As will be understood, this pattern may be repeated for very long overall lengths.

When the section lengths are distributed in accordance with the foregoing relationship, it has been found that reflections from one connection do not accumulate with reflections from another connection over the entire band of frequency. It may be noted, however, that the average VSWR over the band is slightly higher than that which can be obtained for a single frequency using the techniques of the prior art.

It is significant to note that, in arriving at this advantageous progressive distribution of section lengths, the present inventors tried various other section length distributions, including essentially random distributions, but the progressive distribution which is disclosed and claimed herein was found to be significantly superior.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A multi section run of R.F. transmission line having low VSWR characteristics over a band of frequencies where F3 is a selected frequency within said band, said transmission line run comprising a series of N sections having respective lengths l connected in series by joints which cause small impedance discontinuities, the lengths l of the N sections being distributed essentially according to the relationship $$l = L + \frac{\lambda(n-1)}{2N} \quad \text{for } n = 1 \text{ to } N$$

where L is a nominal section length, λ is the wavelength corresponding to F3, and n is a designator for the respective section.

2. A multi section run of R.F. transmission line having low VSWR characteristics over a band of frequencies F1 to F2 where F3 is a selected frequency within said band, said transmission line run comprising a series of N sections having respective lengths l connected in series by flanged joints, which cause small impedance discontinuities, the lengths l of the N sections being distributed essentially according to the relationship $$l = L + \frac{\lambda(n-1)}{2N} \text{ for } n = 1 \text{ to } N$$

where L is a nominal section length, λ is the wavelength corresponding to F3, and n is a designator for the respective section.

3. A transmission line run as set forth in claim 2 wherein each of said sections comprises an inner tubular conductor and an outer tubular conductor which are supported in concentric relationship at each of said flanged joints by an anchor insulator.

4. A transmission line run as set forth in claim 3 wherein said anchor insulator supports an expansion joint which permits relative longitudinal movement of adjacent ends of successive inner conductors in the series thereby to accommodate differential expansion of said inner and outer conductors.

5. A transmission line run as set forth in claim 2 wherein said frequency F1 is about 470 MHz and said frequency F2 is about 806 MHz.

6. A transmission line run as set forth in claim 5 wherein said frequency F3 is about 775 MHz.

7. A multi section run of R.F. transmission line having low VSWR characteristics over a band of frequencies F1 to F2 where F3 is a selected frequency within said band, said transmission line run comprising a series of N sections joined at respective junctioning each one of said N section having respective lengths l and comprising an inner tubular conductor and an outer tubular conductor which are supported in concentric relationship by anchor insulators at the respective junctions between successive sections, each junction causing small impedance discontinuities, the lengths l of the N sections being distributed essentially according to the relationship $$l = L + \frac{\lambda(n-1)}{2N} \text{ for } n = 1 \text{ to } N$$

where L is a nominal section length, λ is the wavelength corresponding to F3, and n is a designator for the respective section.

8. A transmission line run as set forth in claim 7 wherein said frequency F1 is about 470 MHz, said frequency F2 is about 806 MHz, and said frequency F3 is about 775 MHz.

9. A transmission line run as set forth in claim 8 wherein said nominal length L is about 20 feet.

10. A transmission line run as set forth in claim 9 wherein said outer conductor has a diameter of about six inches.

* * * * *